US009531130B1

(12) United States Patent
Phillips et al.

(10) Patent No.: US 9,531,130 B1
(45) Date of Patent: Dec. 27, 2016

(54) ELECTRICAL CONNECTOR HAVING RESONANCE CONTROL

(71) Applicant: TYCO ELECTRONICS CORPORATION, Berwyn, PA (US)

(72) Inventors: Michael John Phillips, Camp Hill, PA (US); Thomas Taake de Boer, Hummelstown, PA (US); Bruce Allen Champion, Camp Hill, PA (US); John Joseph Consoli, Harrisburg, PA (US); Sandeep Patel, Middletown, PA (US); Linda Ellen Shields, Camp Hill, PA (US)

(73) Assignee: TYCO ELECTRONICS CORPORATION, Berwyn, PA (US)

( * ) Notice: Subject to any disclaimer, the term of this patent is extended or adjusted under 35 U.S.C. 154(b) by 0 days.

(21) Appl. No.: 14/993,832

(22) Filed: Jan. 12, 2016

(51) Int. Cl.
*H01R 24/00* (2011.01)
*H01R 13/6471* (2011.01)
*H01R 13/6585* (2011.01)
*H01R 12/70* (2011.01)

(52) U.S. Cl.
CPC ..... *H01R 13/6471* (2013.01); *H01R 12/7005* (2013.01); *H01R 13/6585* (2013.01)

(58) Field of Classification Search
CPC ..... H01R 12/73; H01R 12/737
USPC ..... 439/637, 941, 108, 74
See application file for complete search history.

(56) References Cited

U.S. PATENT DOCUMENTS

| | | | | |
|---|---|---|---|---|
| 6,926,565 | B2 * | 8/2005 | Fogg | H01R 12/721 439/862 |
| 7,371,117 | B2 | 5/2008 | Gailus | |
| 7,833,068 | B2 * | 11/2010 | Bright | H01R 13/502 439/733.1 |
| 8,177,564 | B1 | 5/2012 | Ito et al. | |
| 8,523,583 | B2 | 9/2013 | Ito | |
| 9,028,281 | B2 * | 5/2015 | Kirk | H01R 12/724 439/701 |
| 2015/0255904 | A1 | 9/2015 | Ito | |

* cited by examiner

*Primary Examiner* — Phuong Dinh

(57) ABSTRACT

An electrical connector includes a housing having a mating housing and a contact organizer. The mating housing has a mating slot configured to receive a mating connector having contact pads. The contact organizer has signal and ground contact channels separated by separating walls with inner ends between the separating walls. The contact organizer has lossy fillers at the inner ends of the ground contact channels. The lossy fillers are manufactured from lossy material capable of absorbing electrical resonance propagating through the housing. The electrical connector includes a contact assembly disposed in the housing with ground contacts and signal contacts interspersed between corresponding ground contacts in corresponding ground and signal contact channels of the contact organizer. The ground contacts are positioned adjacent the lossy fillers at the inner ends of the corresponding ground contact channels.

20 Claims, 10 Drawing Sheets

ELECTRICAL CONNECTOR HAVING RESONANCE CONTROL

BACKGROUND OF THE INVENTION

The subject matter herein relates generally to electrical connectors having signal and ground contacts.

Some communication systems utilize electrical connectors mounted to a circuit board to interconnect other components for data communication. For example, the electrical connector may include a housing holding contacts terminated to the circuit board. The housing and contacts define a mating interface for mating with a mating connector such as a circuit card, a plug connector, and the like for connecting such mating connector to the circuit board. Some known electrical connectors have performance problems, particularly when transmitting at high data rates. For example, the electrical connectors typically utilize differential pair signal contacts to transfer high speed signals. Ground contacts improve signal integrity. However, electrical performance of known communication connectors, when transmitting the high data rates, is inhibited by noise from cross-talk and by return loss. Such issues are more problematic with small pitch high speed data connectors, which are noisy and exhibit higher than desirable return loss due to the close proximity of signal and ground contacts. Energy from ground contacts on either side of the signal pair may be reflected in the space between the ground contacts and such noise results in reduced connector performance and throughput.

A need remains for a high density, high speed electrical connector having reliable performance.

BRIEF DESCRIPTION OF THE INVENTION

In an embodiment, an electrical connector is provided including a housing having a mating housing and a contact organizer. The mating housing has a mating slot configured to receive a mating connector having contact pads. The contact organizer has contact channels separated by separating walls. The contact channels have inner ends between the separating walls and open outer ends opposite the inner ends. The contact channels include signal contact channels and ground contact channels. The contact organizer has lossy fillers at the inner ends of the ground contact channels. The lossy fillers are manufactured from lossy material capable of absorbing electrical resonance propagating through the housing. The electrical connector includes a contact assembly disposed in the housing. The contact assembly has ground contacts and signal contacts interspersed between corresponding ground contacts. The ground and signal contacts are received in corresponding ground and signal contact channels of the contact organizer. The ground contacts are positioned adjacent the lossy fillers at the inner ends of the corresponding ground contact channels.

In another embodiment, an electrical connector is provided including a contact assembly having ground contacts and signal contacts interspersed between corresponding ground contacts. The ground and signal contacts each have mating ends configured for mating with contact pads of a mating connector, contact tails opposite the mating ends, and transition segments between the mating ends and the contact tails. The ground and signal contacts are arranged in a first array and a second array of first and second ground contacts, respectively, and first and second signal contacts, respectively. The electrical connector includes a housing having a mating housing and a contact organizer holding the contact assembly. The mating housing has a mating slot configured to receive the mating connector. The first ground contacts and the first signal contacts are arranged on a first side of the mating slot and the second ground contacts and the second signal contacts being arranged on a second side of the mating slot. The contact organizer has a base between opposite first and second sides. The contact organizer has contact channels on the first and second sides. The contact channels are separated by separating walls. The contact channels have inner ends at the base and open outer ends opposite the inner ends. The contact channels include signal contact channels and ground contact channels on both the first and second sides receiving corresponding signal contacts and ground contacts. The contact organizer has lossy fillers in the base at the inner ends of the ground contact channels. The lossy fillers are manufactured from lossy material capable of absorbing electrical resonance propagating through the housing.

DETAILED DESCRIPTION OF THE INVENTION

Embodiments set forth herein may include various electrical connectors that are configured for communicating data signals. The electrical connectors may mate with a corresponding mating connector to communicatively interconnect different components of a communication system. In the illustrated embodiment, the electrical connector is a receptacle connector that is mounted to and electrically coupled to a circuit board. The receptacle connector is configured to mate with a pluggable input/output (I/O) connector during a mating operation. It should be understood, however, that the inventive subject matter set forth herein may be applicable in other types of electrical connectors. In various embodiments, the electrical connectors provide lossy ground fillers to provide resonance control. Moreover, in various embodiments, the electrical connectors are particularly suitable for high-speed communication systems, such as network systems, servers, data centers, and the like, in which the data rates may be greater than 5 gigabits/second (Gbps). However, one or more embodiments may also be suitable for data rates less than 5 Gbps.

In various embodiments described and/or illustrated herein, the electrical connectors include signal and ground conductors that are positioned relative to each other to form a pattern or array that includes one or more rows (or columns). The signal and ground conductors of a single row (or column) may be substantially co-planar. The signal and ground conductors may be right-angle conductors having a generally 90° bend along the length of the conductors. The signal conductors form signal pairs in which each signal pair is flanked on both sides by ground conductors. The ground conductors electrically separate the signal pairs to reduce electromagnetic interference or crosstalk and to provide a reliable ground return path. The signal and ground conductors in a single row are patterned to form multiple sub-arrays. Each sub-array includes, in order, a ground conductor, a signal conductor, a signal conductor, and a ground conductor. This arrangement is referred to as ground-signal-signal-ground (or GSSG) sub-array. The sub-array may be repeated such that an exemplary row of conductors may form G-S-S-G-G-S-S-G-G-S-S-G, wherein two ground conductors are positioned between two adjacent signal pairs. In the illustrated embodiment, however, adjacent signal pairs share a ground conductor such that the pattern forms G-S-S-G-S-S-G-S-S-G. In both examples above, the sub-array is referred to as a GSSG sub-array. More specifically, the term "GSSG sub-array" includes sub-arrays that share one or more intervening ground conductors.

Figure 1:
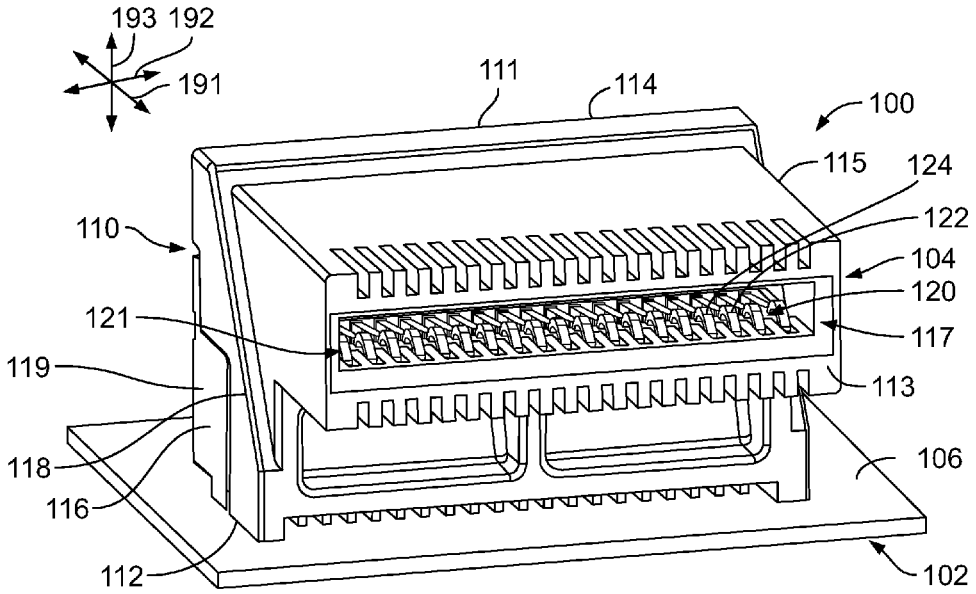
FIG. 1 is a front perspective view of a circuit board assembly formed in accordance with an embodiment.
Figure 2:
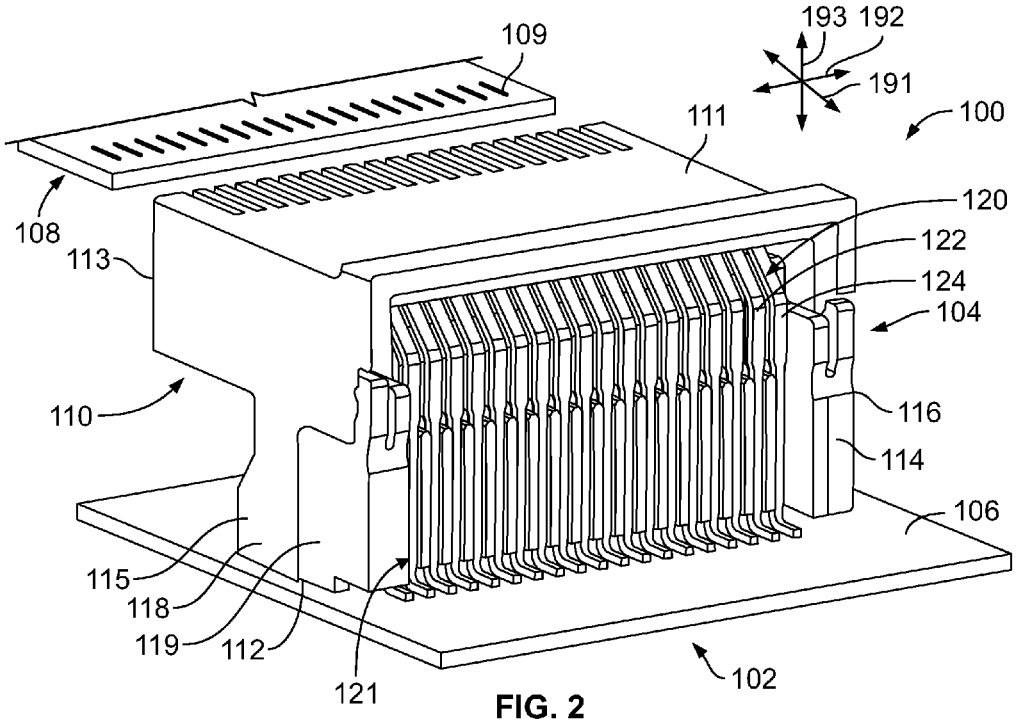
FIG. 2 is a rear perspective view of the circuit board assembly.

FIG. 1 is a front perspective view of a circuit board assembly 100 formed in accordance with an embodiment. FIG. 2 is a rear perspective view of the circuit board assembly 100. The circuit board assembly 100 includes a circuit board 102 and an electrical connector 104 that is mounted onto a board surface 106 of the circuit board 102. A mating connector 108 (FIG. 2) is configured to be mated with the electrical connector 104. In the illustrated embodiment, the mating connector 108 is or includes a circuit card, such as a paddle card style printed circuit board; however other types of mating components may be used in alternative embodiments. For example, the mating connector 108 may be a plug connector having a housing holding contacts or a circuit card. In the illustrated embodiment, the mating connector 108 includes contact pads 109 on one or both surfaces of the mating connector 108 configured to be electrically connected to corresponding contacts of the electrical connector 104.

The circuit board assembly 100 is oriented with respect to mutually perpendicular axes, including a mating axis 191, a lateral axis 192, and a vertical or elevation axis 193. In FIG. 1, the vertical axis 193 extends parallel to a gravitational force direction. It should be understood, however, that embodiments described herein are not limited to having a particular orientation with respect to gravity. For example, the lateral axis 192 or the mating axis 191 may extend parallel to the gravitational force direction in other embodiments. The mating connector 108 is mated with the electrical connector 104 along the mating axis 191.

In some embodiments, the circuit board assembly 100 may be a daughter card assembly that is configured to engage a backplane or midplane communication system (not shown). In other embodiments, the circuit board assembly 100 may include a plurality of the electrical connectors 104 mounted to the circuit board 102 along an edge of the circuit board 102 in which each of the electrical connectors 104 is configured to engage a corresponding pluggable input/output (I/O) connector, such as or including the mating connector 108. The electrical connectors 104 and mating connectors 108 may be configured to satisfy certain industry standards, such as, but not limited to, the small-form factor pluggable (SFP) standard, enhanced SFP (SFP+) standard, quad SFP (QSFP) standard, C form-factor pluggable (CFP) standard, and 10 Gigabit SFP standard, which is often referred to as the XFP standard. In some embodiments, the pluggable I/O connector may be configured to be compliant with a small form factor (SFF) specification, such as SFF-8644 and SFF-8449 HD. In some embodiments, the electrical connectors 104 described herein may be high-speed electrical connectors that are capable of transmitting data at a rate of at least about five (5) gigabits per second (Gbps). In some embodiments, the electrical connectors 104 described herein may be high-speed electrical connectors that are capable of transmitting data at a rate of at least about 10 Gbps, or more.

Although not shown, each of the electrical connectors 104 may be positioned within a receptacle cage. The receptacle cage may be configured to receive one or more of the mating connectors 108 during a mating operation and direct the mating connector 108 toward the corresponding electrical connector 104. The circuit board assembly 100 may also include other devices that are communicatively coupled to the electrical connectors 104 through the circuit board 102. The electrical connectors 104 may be positioned proximate to one edge of the circuit board 102.

The electrical connector 104 includes a housing 110 having a plurality of walls, including a first end 111, a second end 112, a front end 113, a rear end 114, a first side 115 and a second side 116. The housing 110 may include greater or fewer walls in alternative embodiments. The housing sides 115, 116 extend between the front and rear ends 113, 114 and the first and second ends 111, 112. The front end 113 and the rear end 114 face in opposite directions along the mating axis 191. The first and second sides 115, 116 face in opposite directions along the lateral axis 192. The first and second ends 111, 112 face in opposite directions along the vertical axis 193. The housing 110 extends a height between the first end 111 and the second end 112. The housing 110 extends a width between the front end 113 and the rear end 114. The housing 110 extends a length between the first and second sides 115, 116.

In the illustrated embodiment, the first end 111 defines a top end and may be referred to hereinafter as a top end 111 and the second end 112 defines a bottom end and may be referred to hereinafter as a bottom end 112. The bottom end 112 faces the board surface 106 and may be mounted to or engage the board surface 106. The top end 111 faces away from the circuit board 102 and may have the greatest elevation of the housing walls with respect to the board surface 106.

In the illustrated embodiment of FIG. 1, the electrical connector 104 is a right-angle connector such that the front end 113 (which is the receiving side) and the bottom end 112 (which is the mounting side) are oriented substantially perpendicular or orthogonal to each other. More specifically, the front end 113 faces in a receiving direction along the mating axis 191 and the mounting side faces in a mounting direction along the vertical axis 193. In other embodiments, the receiving side and the mounting side may face in different directions than those shown in FIG. 1. For example, the top end 111 may define the receiving side that receives the mating connector 108 such that the electrical connector 104 is a vertical connector rather than a right-angle connector.

The housing 110 includes a mating slot 117 (FIG. 1) that is sized and shaped to receive a portion of the mating connector 108. For example, in the illustrated embodiment, the mating slot 117 is sized and shaped to receive an edge of the mating connector 108, including the contact pads 109. The mating slot 117 is positioned between the top and bottom ends 111, 112. The mating slot 117 is open at the front end 113 with an upper portion of the housing 110 positioned between the mating slot 117 and the top end 111 and a lower portion of the housing 110 positioned between the mating slot 117 and the bottom end 112. The mating slot 117 is shown open at the front end 113; however the mating slot 117 may have other locations in alternative embodiments, such as open at the top end 111.

In an exemplary embodiment, the housing 110 may be a multi-piece housing. For example, the housing 110 includes a mating housing 118 and a contact organizer 119, which are separate and discrete pieces coupled together at a mating interface. The mating housing 118 is coupled to the contact organizer 119 and may be positioned both forward and above the contact organizer 119 and with the contact organizer 119 both rearward of and below the mating housing 118; however other configurations are possible in alternative embodiments. The contact organizer 119 holds relative positions of the contacts for mounting to the circuit board 102 and directs the contacts into the mating housing 118. The mating housing 118 holds the relative positions of the contacts for mating with the mating connector 108. The housing 110 may include other housing pieces that are coupled to the mating housing 118 and/or the contact organizer 119, which may be used to support the contacts, to secure the pieces together, to secure the housing 110 to another component, such as the circuit board 102 or for other purposes. In alternative embodiments, the mating housing 118 and the contact organizer 119 (and/or other pieces) may include a single, unitary body, such as a molded, dielectric body, where the mating housing 118 and the contact organizer 119 are considered a mating housing segment 118 and a contact organizer segment 119 of the single housing 110.

The electrical connector 104 includes a contact assembly 120 held by the housing 110. The contact assembly 120 includes one or more contact arrays 121 (for example, an upper contact array and a lower contact array or a front contact array and a rear contact array) disposed in the housing 110. The contact assembly 120 is held by the contact organizer 119 and the mating housing 118. In an exemplary embodiment, each contact array 121 includes signal contacts 122 and ground contacts 124 that extend into the mating slot 117 for mating with corresponding contact pads 109. The contacts 122, 124 are held by the mating housing 118 within the mating slot 117, such as along both sides of the mating slot 117. The signal and ground contacts 122, 124 also extend to the bottom end 112 for mounting to the circuit board 102. For example, ends of the signal and ground contacts 122, 124 may be surface mounted (for example, soldered) to the circuit board 102 or press-fit into plated vias in the circuit board 102 for mechanical and electrical connection to the circuit board 102. The contact organizer 119 holds the ends of the signal and ground contacts 122, 124 at the bottom end 112 for mounting to the circuit board 102.

The contact assembly 120 is arranged in the housing 110 such that the signal and ground contacts 122, 124 of one contact array 121 are arranged in a first row (for example, an upper row) and the signal and ground contacts 122, 124 of the other contact array 121 are arranged in a second row (for example, a lower row). The signal and ground contacts 122, 124 arranged in the upper row are arranged between the mating slot 117 and the top end 111 and the signal and ground contacts 122, 124 arranged in the lower row are arranged between the mating slot 117 and the bottom end 112. The first and second rows of signal and ground contacts 122, 124 are arranged on opposite sides of the mating slot 117. The signal and ground contacts 122, 124 may be arranged in a front row and a rear row generally at the front end 113 and the rear end 114, respectively. In an exemplary embodiment, the first row defines both an upper row and a rear row as the corresponding signal and ground contacts 122, 124 are arranged both along the top end 111 and the rear end 114, and the second row defines both a lower row and a front row as the corresponding signal and ground contacts 122, 124 are arranged both along the bottom end 112 and the front end 113.

The signal and ground contacts 122, 124 may be arranged to form a plurality of ground-signal-signal-ground (GSSG) sub-arrays in which each pair of signal contacts 122 is located between two ground contacts 124. The electrical connector 104 may also include at least one lossy filler 130 (shown in FIG. 6). The lossy fillers 130 are distributed throughout the housing 110 in select locations, such as in the contact organizer 119 adjacent to corresponding ground contacts 124. Each of the lossy fillers 130 is configured to absorb at least some electrical resonance that propagates along the current path defined by the ground contacts 124 and/or at least some electrical resonance that propagates along the signal path defined by the corresponding signal contacts 122. The lossy filler 130 may be coupled to one or more ground contacts 124, such as directly coupled to the one or more ground contacts 124 at a ground contact interface that directly engages the corresponding ground contact 124. The lossy filler 130 may control or limit undesirable resonances that occur within the ground contacts 124 during operation of the electrical connector 104. The lossy filler 130 may effectively reduce the frequency of energy resonating within the housing 110. The bulk of the material of the contact organizer 119 is manufactured from a low loss dielectric material, such as a plastic material. The low loss dielectric material has dielectric properties that have relatively little variation with frequency.

The lossy filler 130 may be provided at or near the rear end 114 to couple to one or more ground contacts 124 in the rear row. The lossy filler 130 may be provided at or near the front end 113 to couple to one or more ground contacts 124 in the front row. Optionally, the lossy filler 130 may extend a distance between the front end 113 and the rear end 114 to couple to ground contacts 124 in both the front and rear rows. For example, the lossy filler 130 may span the entire width of the contact organizer 119 to engage ground contacts at both the front and the rear of the contact organizer 119. The lossy filler 130 may be provided at or near the top end 111 to couple to one or more ground contacts 124 in the upper row. The lossy filler 130 may be provided at or near the bottom end 112 to couple to one or more ground contacts 124 in the lower row and/or the upper row.

In an exemplary embodiment, the lossy filler 130 includes lossy material capable of absorbing at least some electrical resonance that propagates along the current paths defined by the signal contacts 122 and/or the ground contacts 124 through the electrical connector 104. For example, the lossy material may be embedded in the housing 110. The lossy material has dielectric properties that vary with frequency. The lossy material provides lossy conductivity and/or magnetic lossiness through a portion of the electrical connector 104. The lossy material is able to conduct electrical energy, but with at least some loss. The lossy material is less conductive than conductive material, such as the conductive material of the contacts 122, 124. The lossy material may be designed to provide electrical loss in a certain, targeted frequency range, such as by selection of the lossy material, placement of the lossy material, proximity of the lossy material to the ground paths and the signal paths, and the like. The lossy material may include conductive particles (or fillers) dispersed within a dielectric (binder) material. The dielectric material, such as a polymer or epoxy, is used as a binder to hold the conductive particle filler elements in place. These conductive particles then impart loss to the lossy material. In some embodiments, the lossy material is formed by mixing binder with filler that includes conductive particles. Examples of conductive particles that may be used as a filler to form electrically lossy materials include carbon or graphite formed as fibers, flakes, or other particles. Metal in the form of powder, flakes, fibers, or other conductive particles may also be used to provide suitable lossy properties. Alternatively, combinations of fillers may be used. For example, metal plated (or coated) particles may be used. Silver and nickel may also be used to plate particles. Plated (or coated) particles may be used alone or in combination with other fillers, such as carbon flakes. In some embodiments, the fillers may be present in a sufficient volume percentage to allow conducting paths to be created from particle to particle. For example when metal fiber is used, the fiber may be present at an amount up to 40% by volume or more. The lossy material may be magnetically lossy and/or electrically lossy. For example, the lossy material may be formed of a binder material with magnetic particles dispersed therein to provide magnetic properties. The magnetic particles may be in the form of flakes, fibers, or the like. Materials such as magnesium ferrite, nickel ferrite, lithium ferrite, yttrium garnet and/or aluminum garnet may be used as magnetic particles. In some embodiments, the lossy material may simultaneously be an electrically-lossy material and a magnetically-lossy material. Such lossy materials may be formed, for example, by using magnetically-lossy filler particles that are partially conductive or by using a combination of magnetically-lossy and electrically-lossy filler particles As used herein, the term "binder" encompasses material that encapsulates the filler or is impregnated with the filler. The binder material may be any material that will set, cure, or can otherwise be used to position the filler material. In some embodiments, the binder may be a thermoplastic material such as those traditionally used in the manufacture of electrical connector housings. The thermoplastic material may be molded, such as molding of the lossy filler 130 into the desired shape and/or location. However, many alternative forms of binder materials may be used. Curable materials, such as epoxies, can serve as a binder. Alternatively, materials such as thermosetting resins or adhesives may be used.

Electrical performance of the communication connector 104 is enhanced by the inclusion of the lossy material in the lossy fillers 130. For example, at various data rates, including high data rates, return loss is inhibited by the lossy material. For example, the return loss of the small pitch, high speed data of the contact arrays 121 due to the close proximity of signal and ground contacts 122, 124 is reduced by the lossy fillers 130. For example, energy from the ground contacts 124 on either side of the signal pair reflected in the space between the ground contacts 124 is absorbed, and thus connector performance and throughput is enhanced.

Figure 3:
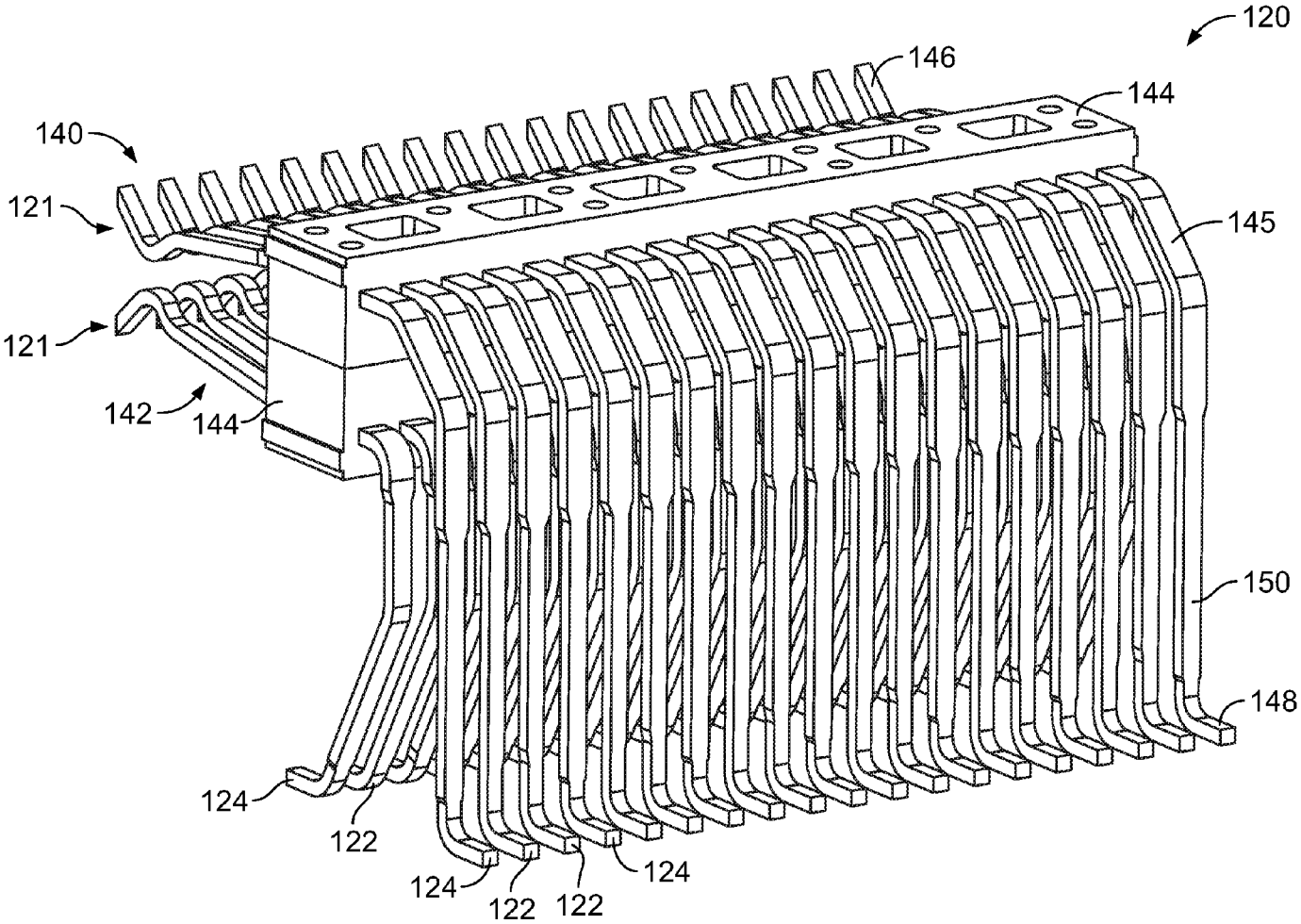
FIG. 3 is a rear perspective view of a portion of an electrical connector of the circuit board assembly showing a contact assembly formed in accordance with an exemplary embodiment.

FIG. 3 is a rear perspective view of a portion of the electrical connector 104 showing the contact assembly 120 formed in accordance with an exemplary embodiment. The contact assembly 120 includes first and second leadframe assemblies 140, 142. Each leadframe assembly 140, 142 includes one of the contact arrays 121 and an overmolded body 144 supporting the ground contacts 124 and the signal contacts 122 of the contact arrays 121. The overmold bodies 144 are overmolded over the leadframes of contacts 122, 124 to hold the relative positions of the contacts 122, 124. During manufacture, the signal and ground contacts 122, 124 may be stamped and formed contacts defining leadframes. The leadframes arrange the contacts in an array, and carrier strips of the leadframe may be removed after stamping and forming to define the contact array 121. The leadframes are overmolded to form the overmold bodies 144.

The leadframe assemblies 140, 142 may be stacked with the first leadframe assembly 140 above the second leadframe assembly 142. As such, the first leadframe assembly 140 may be an upper leadframe assembly and the second leadframe assembly 142 may be a lower leadframe assembly with the corresponding component parts identified with such upper and lower identifiers, such as an upper contact array or an upper overmold body, and the like.

The signal contacts 122 in the first leadframe assembly 140 may also be identified specifically as upper or rear signal contacts, and the ground contacts 124 in the first leadframe assembly 140 may also be identified specifically as upper or rear ground contacts, while the signal and ground contacts 122, 124 in the second leadframe assembly 142 may be identified as lower or front signal and ground contacts. The upper and lower signal and ground contacts 122, 124 generally have similar features, which may be referred to herein with like reference numerals; however, the upper signal and ground contacts 122, 124 may be shaped differently than the lower signal and ground contacts 122, 124.

The contacts 122, 124 each have a main body 145 extending between a mating end 146 and a terminating end 148. The contacts 122, 124 may have a deflectable mating beam at the mating end 146 for mating with the contact pads 109 of the mating connector 108 (both shown in FIG. 1). The contacts 122, 124 may have a solder tail at the terminating end 148 for surface mounting to the circuit board 102 (shown in FIG. 1). Other types of mating or terminating portions may be provided in alternative embodiments, such as a compliant pin at the terminating end 148. The contacts 122, 124 have transition segments 150 between the mating and terminating ends 146, 148.

Figure 4:
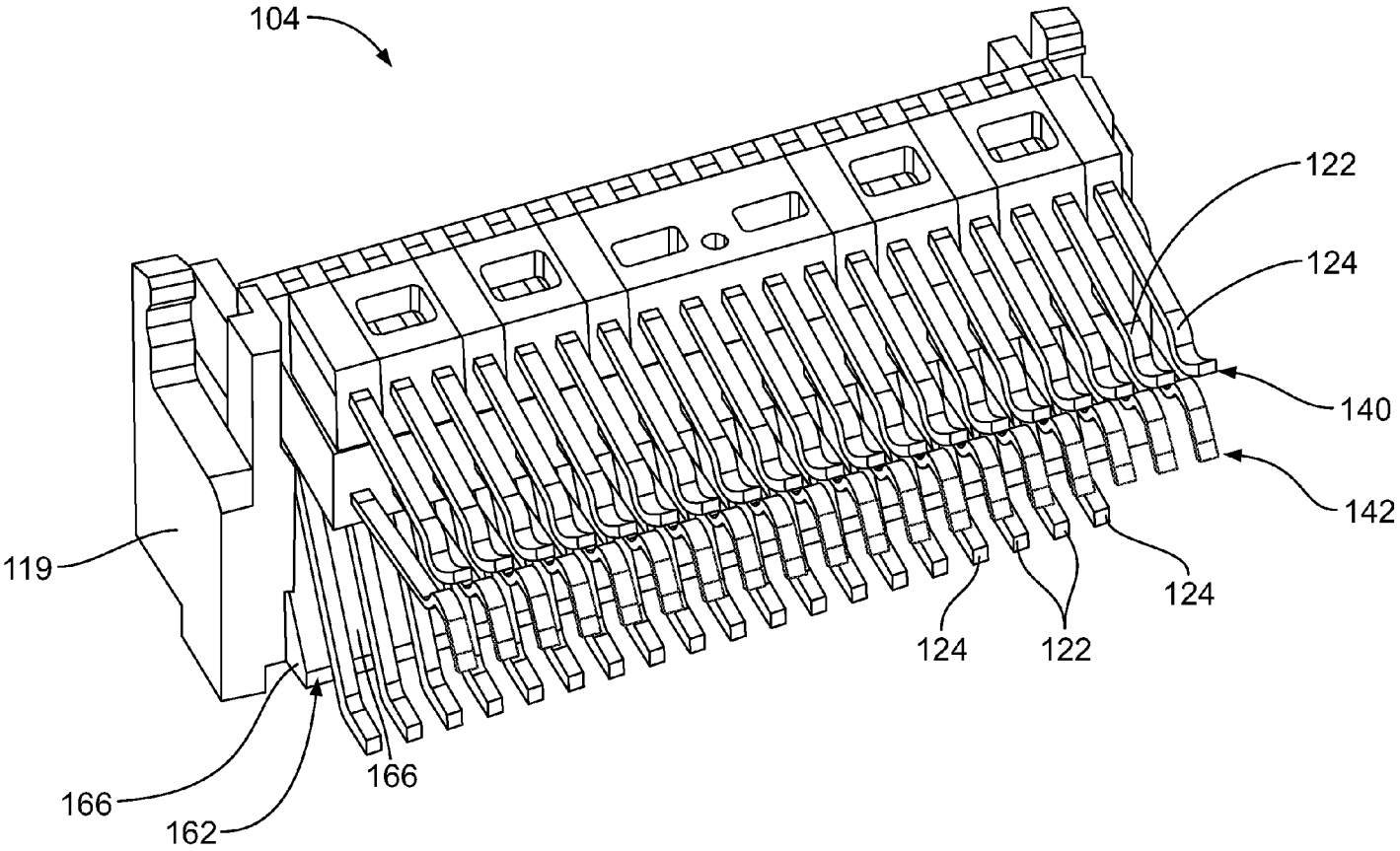
FIG. 4 is a front perspective view of a portion of the electrical connector showing first and second leadframe assemblies of the contact assembly loaded into a contact organizer of the electrical connector.
Figure 5:
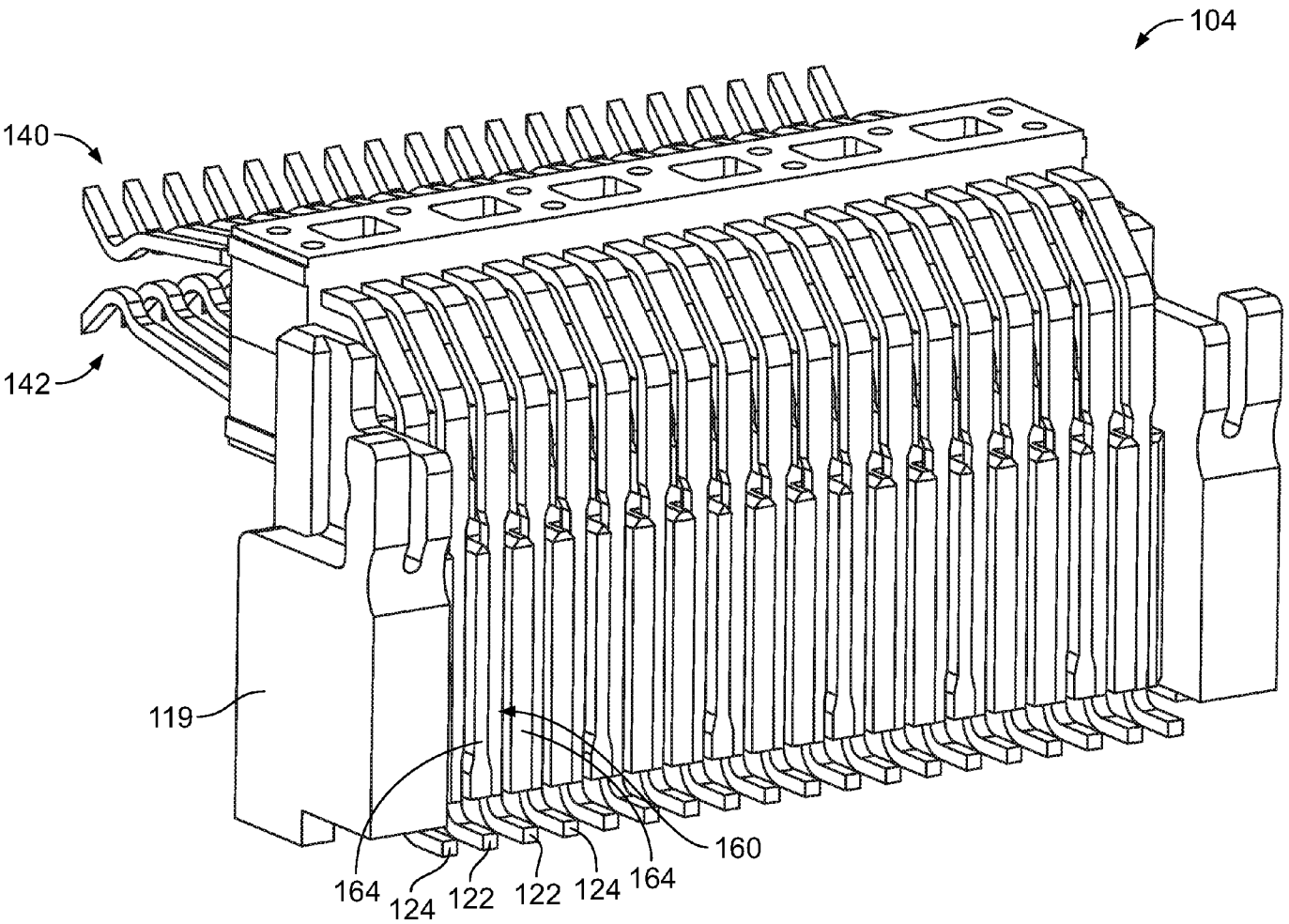
FIG. 5 is a rear perspective view of a portion of the electrical connector showing the first and second leadframe assemblies loaded into the contact organizer.

FIG. 4 is a front perspective view of a portion of the electrical connector 104 showing the first and second leadframe assemblies 140, 142 loaded into the contact organizer 119. FIG. 5 is a rear perspective view of a portion of the electrical connector 104 showing the first and second leadframe assemblies 140, 142 loaded into the contact organizer 119. The mating housing 118 (shown in FIG. 1) may be coupled to the contact organizer 119 over the leadframe assemblies 140, 142, such as from the front. In an exemplary embodiment, the contact organizer 119 organizes and aligns the signal and ground contacts 122, 124 of both leadframe assemblies 140, 142. For example, the contact organizer 119 includes rear contact channels 160 (FIG. 5) receiving the upper signal and ground contacts 122, 124. The contact organizer 119 includes front contact channels 162 (FIG. 4) receiving the lower signal and ground contacts 122, 124. The contact channels 160, 162 that receive signal contacts 122 may be referred to as signal contact channels 160, 162 while the contact channels 160, 162 that receive the ground contacts 124 may be referred to as ground contact channels 160, 162.

The rear contact channels 160 are open at the rear end of the contact organizer 119 and spacers or separating walls 164 are provided at opposite sides of each of the contact channels 160. The separating walls 164 may hold and position the upper contacts 122, 124 in the contact channels 160. The front contact channels 162 are open at the front end of the contact organizer 119 and spacers or separating walls 166 are provided at opposite sides of each of the contact channels 162. The separating walls 166 may hold and position the lower contacts 122, 124 in the contact channels 162.

Figure 6:
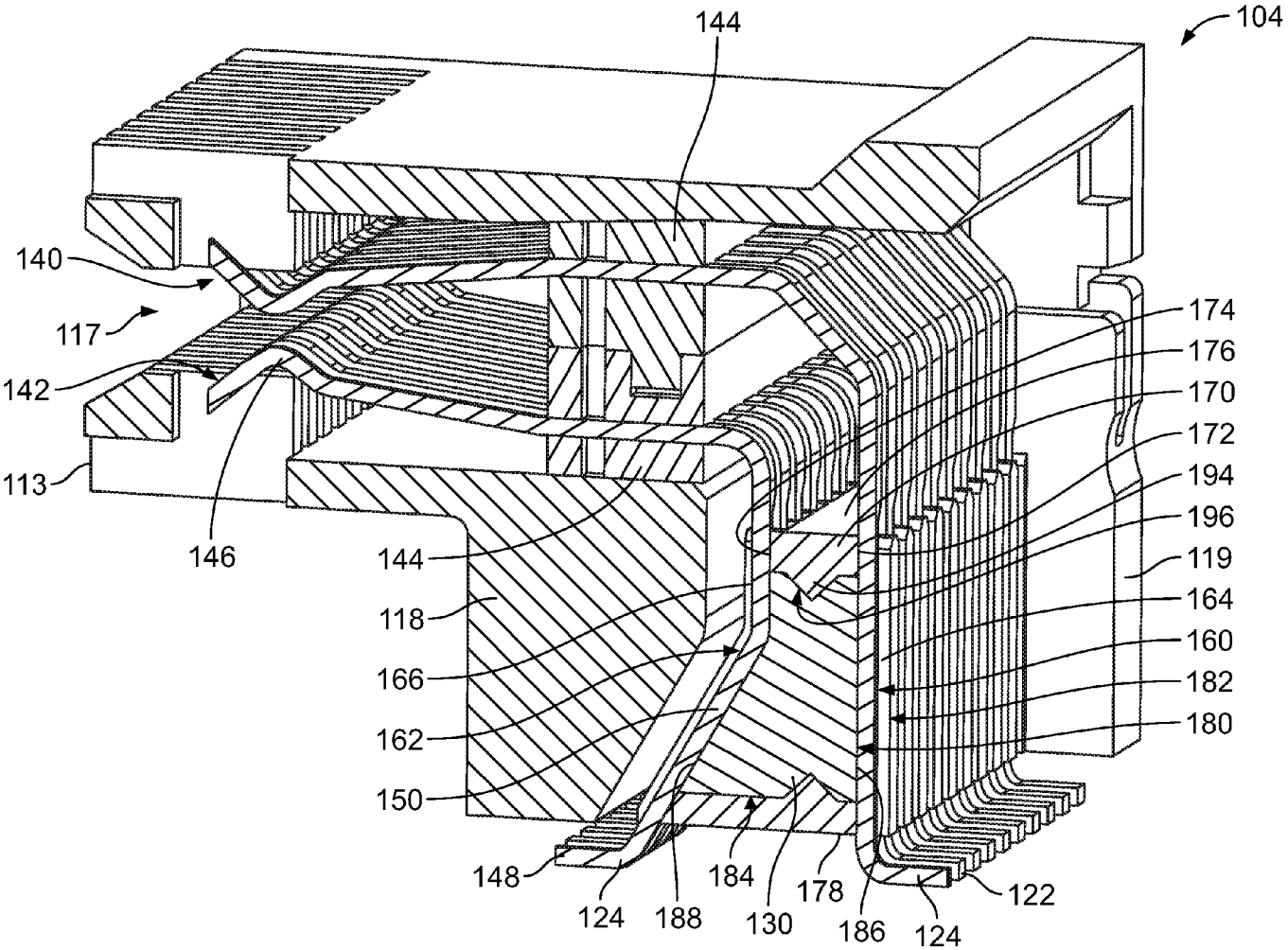
FIG. 6 is a partial sectional view of the electrical connector in accordance with an exemplary embodiment.

FIG. 6 is a partial sectional view of the electrical connector 104 in accordance with an exemplary embodiment. The mating housing 118 is shown coupled to the contact organizer 119. The leadframe assemblies 140, 142 are held in the mating housing 118. For example, the overmold bodies 144 position the contacts 122, 124 in the mating slot 117 with the mating ends 146 at the front end 113 for mating with the mating connector 108 (shown in FIG. 2). The transition segments 150 transition from the overmold bodies 144 to the contact organizer 119 and are received in the contact channels 160, 162. The contact organizer 119 holds the terminating ends 148 for termination to the circuit board 102 (shown in FIG. 1).

In an exemplary embodiment, the contact organizer 119 includes a base 170 extending between a first side 172 and a second side 174 of the contact organizer 119. The base 170 includes a top 176 and a bottom 178. The bottom 178 faces the circuit board 102. In an exemplary embodiment, the mating housing 118 covers the top 176. The base 170 may be manufactured from a low loss dielectric material, such as a plastic material. The low loss dielectric material has dielectric properties that have relatively little variation with frequency.

The rear contact channels 160 are provided at the first side 172 and the front contact channels 162 are provided at the second side 174. In an exemplary embodiment, the contact channels 160, 162 have inner ends 180 at the base 170 and open outer ends 182 that are open at the first and second sides 172, 174, respectively. The contacts 122, 124 may be loaded into the contact channels 160, 162 through the open outer ends 182. The contacts 122, 124 may engage (for example, press against) the inner ends 180. For example, the separating walls 164, 166 may have features that hold the contacts 122, 124 against the inner ends 180. In other various embodiments, the transition segments 150 may be formed (for example, bent) such that the natural internal bias of the contacts 122, 124 holds the contacts 122, 124 against the inner ends 180 when the contacts 122, 124 are loaded into the contact channels 160, 162. In the illustrated embodiment, the rear contact channels 160 are vertical while the front contact channels 162 have pitched or angled portions that direct the terminating ends 148 of the front contacts 122, 124 away from the terminating ends 148 of the rear contacts 122, 124. The base 170 defines a wedge at the front side 174. Other orientations are possible in alternative embodiments, such as both being vertical, both being angled or others.

In an exemplary embodiment, the contact organizer 119 includes pockets 184 in the base 170 that receive the lossy fillers 130. The lossy fillers 130 may be molded into the pockets 184, such as injection molded. For example, the contact organizer 119 may be molded in a multi-shot molding process, such as a two-shot molding process, where the lossy fillers 130 are co-molded with the base 170 from different materials, such as a lossy material and a low loss plastic material, respectively. Alternatively, the lossy fillers 130 may be molded separately and inserted into the pockets 184 during an assembly process.

The pockets 184 may be open at the inner ends 180 of the rear contact channels 160 and/or the front contact channels 162 to receive the lossy fillers 130. In the illustrated embodiment, the pockets 184 extend entirely through the base 170 between the first and second sides 172, 174 and are open to both contact channels 160, 162. Optionally, the pockets 184 may be open at the top 176 and/or the bottom 178; however in the illustrated embodiment, the pockets 184 are closed at both the top 176 and the bottom 178. In an exemplary embodiment, the pockets 184 are associated with the ground contact channels 160, 162 (for example, the contact channels that receive ground contacts 124), and thus the lossy fillers 130 are positioned between the ground contacts 124. The signal contact channels 160, 162 do not include pockets 184. Rather, the low loss dielectric material of the base 170 is provided between the signal contacts 122.

The lossy fillers 130 include at least one edge facing and, in various embodiments, engaging a corresponding ground contact 124. In an exemplary embodiment, each lossy filler 130 includes a first edge 186 engaging the ground contact 124 in the rear contact channel 160 and a second edge 188 engaging the ground contact 124 in the front contact channel 162. The edges 186, 188 may be provided at the inner ends 180 (for example, coplanar with the inner ends 180) and may define at least portions of the surfaces of the inner ends 180. In the illustrated embodiment, the rear edge 186 is substantially vertical while the front edge 188 is angled non-parallel to the rear edge 186; however, other orientations are possible in alternative embodiments.

In an exemplary embodiment, the lossy fillers 130 include a locating feature or key 194 used to locate and/or secure the lossy filler 130 in the base 170. The key 194 may be a groove, as in the illustrated embodiment, a protrusion or another feature. The base 170 may include a complementary locating feature or key 196 that interacts with the key 194. The keys 194, 196 lock the lossy fillers 130 in the contact organizer 119.

Figure 7:
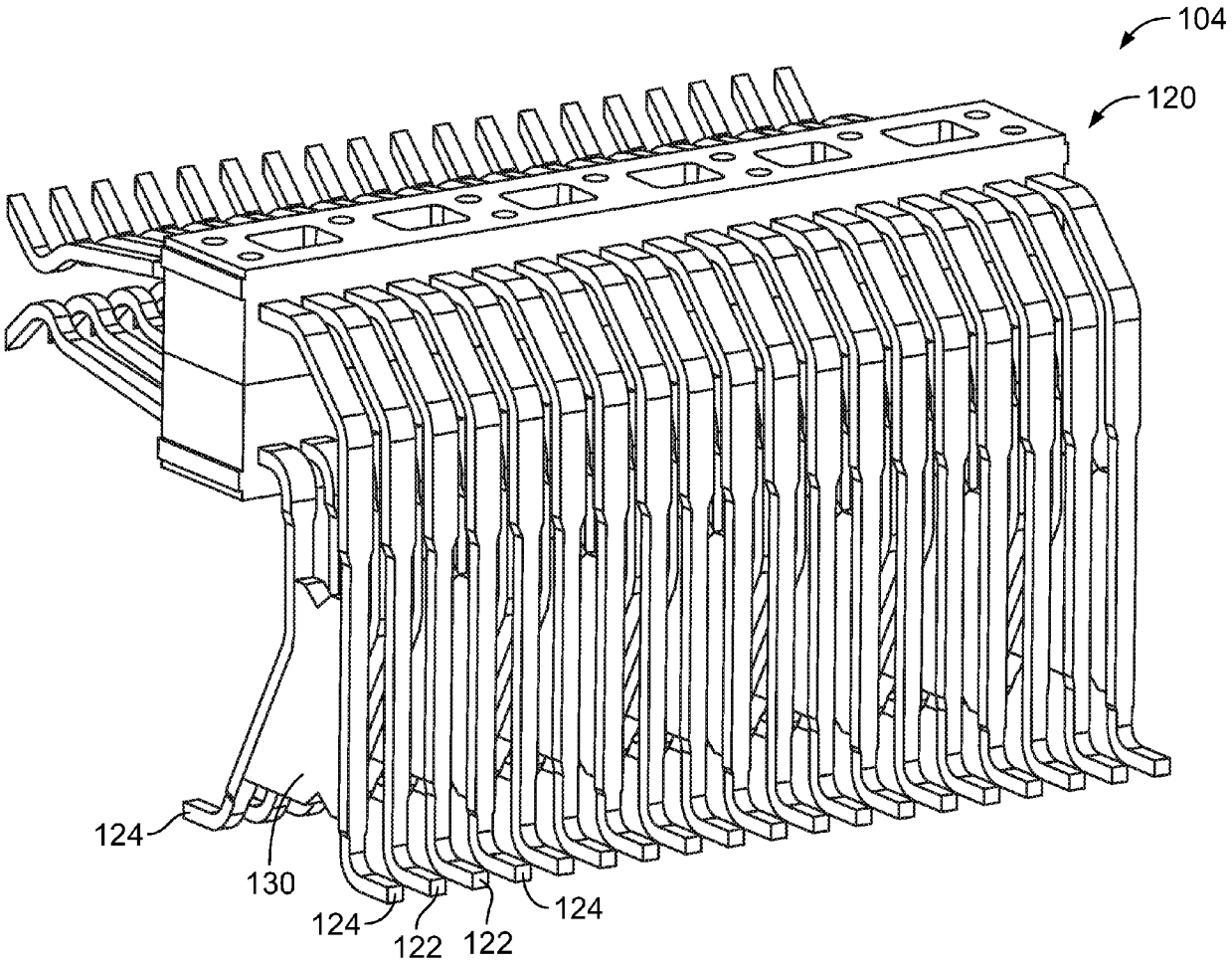
FIG. 7 is a rear perspective view of a portion of the electrical connector showing a contact assembly and lossy fillers in accordance with an exemplary embodiment.

FIG. 7 is a rear perspective view of a portion of the electrical connector 104 showing the contact assembly 120 and the lossy fillers 130 with the housing 110 (shown in FIG. 1) removed to illustrate the location of the lossy fillers 130 relative to the ground contacts 124. The lossy fillers 130 may be generally planar components spaced apart from each other along parallel ground planes. The ground contacts 124 are provided along the ground planes. Pairs of signal contacts 122 are provided between the ground planes.

The lossy fillers 130 are configured to absorb at least some electrical resonance that propagates along the current path defined by the ground contacts 124 and/or at least some electrical resonance that propagates along the signal path defined by the corresponding signal contacts 122. The lossy fillers 130 may control or limit undesirable resonances that occur within the ground contacts 124 during operation of the electrical connector 104. The lossy fillers 130 may effectively reduce the frequency of energy resonating within the contact assembly 120. Electrical performance of the communication connector 104 is enhanced by the inclusion of the lossy material in the lossy fillers 130. For example, at various data rates, including high data rates, return loss is inhibited by the lossy material. For example, the return loss of the small pitch, high speed data of the contact assembly 120 due to the close proximity of signal and ground contacts 122, 124 is reduced by the lossy fillers 130. For example, energy from the ground contacts 124 on either side of the signal pair reflected in the space between the ground contacts 124 is absorbed, and thus connector performance and throughput is enhanced.

Figure 8:
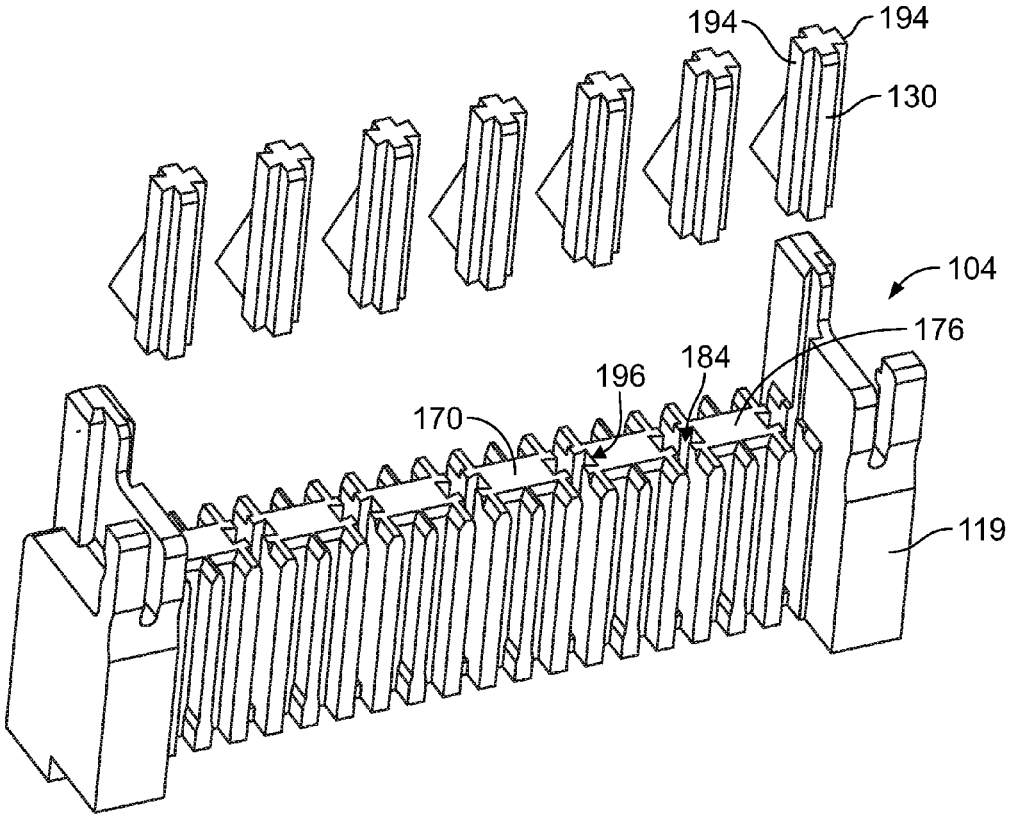
FIG. 8 is a partially exploded view of a portion of the electrical connector showing the contact organizer and the lossy fillers in accordance with an exemplary embodiment.

FIG. 8 is a partially exploded view of a portion of the electrical connector 104 showing the contact organizer 119 and the lossy fillers 130 in accordance with an exemplary embodiment. In the illustrated embodiment, the lossy fillers 130 are separately manufactured (for example, separately molded) from the base 170 of the contact organizer 119. The lossy fillers 130 are loaded into the pockets 184, such as through the top 176. The lossy fillers 130 include the keys 194, in the form of rails along opposite sides of the lossy fillers 130, that are received in slots defining the keys 196 in the base 170.

Figure 9:
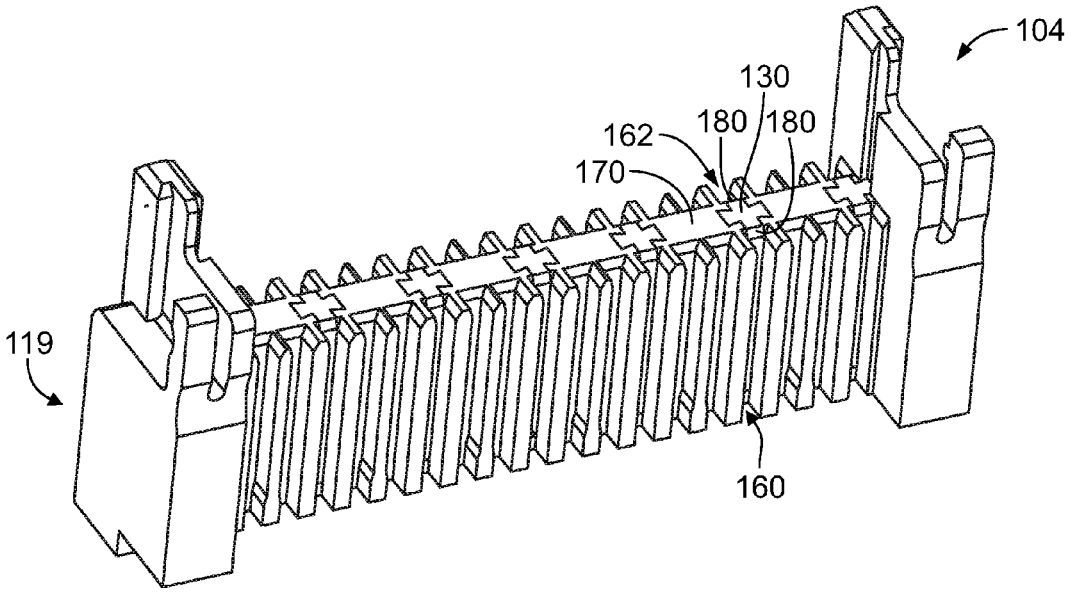
FIG. 9 is an assembled view of a portion of the electrical connector showing the lossy fillers in accordance with an exemplary embodiment.

FIG. 9 is an assembled view of a portion of the electrical connector 104 showing the lossy fillers 130 (of the embodiment shown in FIG. 8) loaded into the base 170 of the contact organizer 119. The lossy fillers 130 are exposed at inner ends 180 of the ground contact channels 160, 162 for interfacing with the ground contacts 124 (shown in FIG. 1).

Figure 10:
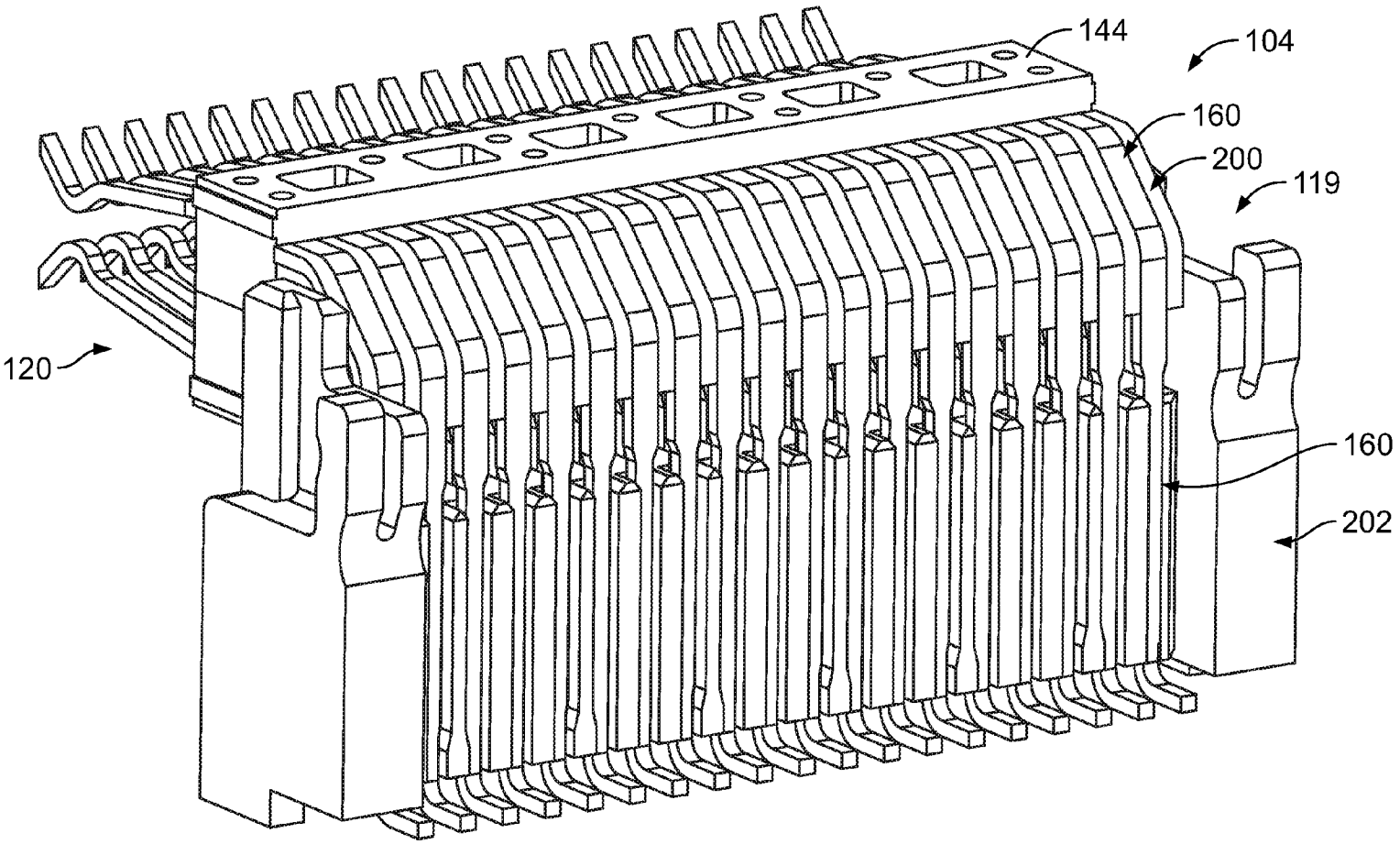
FIG. 10 is a rear perspective view of a portion of the electrical connector showing the contact assembly and contact organizer in accordance with an exemplary embodiment.

FIG. 10 is a rear perspective view of a portion of the electrical connector 104 showing the contact assembly 120 and contact organizer 119 in accordance with an exemplary embodiment. In the illustrated embodiment, the contact organizer 119 includes an upper contact organizer 200 and a lower contact organizer 202. The lower contact organizer 202 may be identical to the contact organizer 119 illustrated above. Alternatively, the lower contact organizer 202 may be similar to the contact organizer 119 but without the lossy fillers therein. The upper contact organizer 200 is positioned above the lower contact organizer 202 between the overmold bodies 144 and the top of the lower contact organizer 202. Both the upper and lower contact organizers 200, 202 include the rear contact channels 160 and the front contact channels 162 (shown in FIG. 11). In an exemplary embodiment, one or both of the upper and lower contact organizers 200, 202 include the lossy fillers 130 (shown in FIG. 11).

Figure 11:
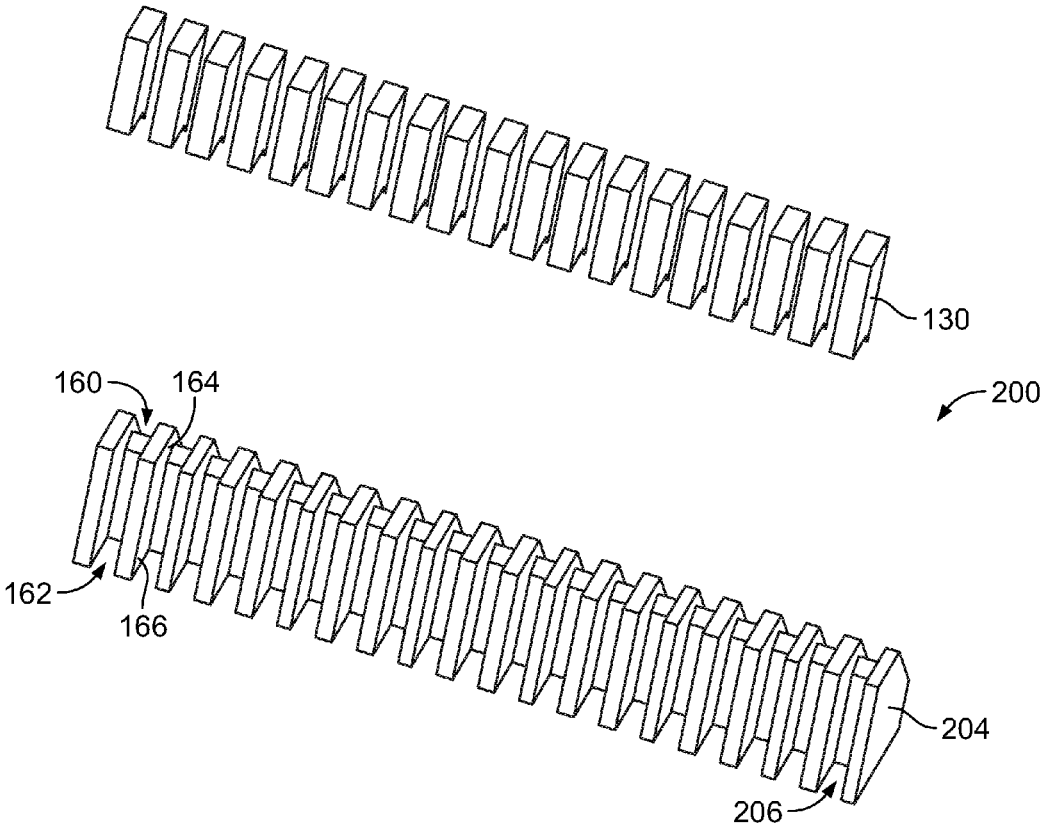
FIG. 11 is an exploded view of a portion of the contact organizer shown in FIG. 10 showing lossy fillers.

FIG. 11 is an exploded view of the upper contact organizer 200. The upper contact organizer 200 includes a base 204 having pockets 206 configured to hold the lossy fillers 130. The upper contact organizer 200 includes the contact channels 160, 162 with the separating walls 164, 166 therebetween. In an exemplary embodiment, the pockets 206 span between the contact channels 160, 162 to engage ground contacts 124 (shown in FIG. 12) held in the upper contact organizer 200.

Figure 12:
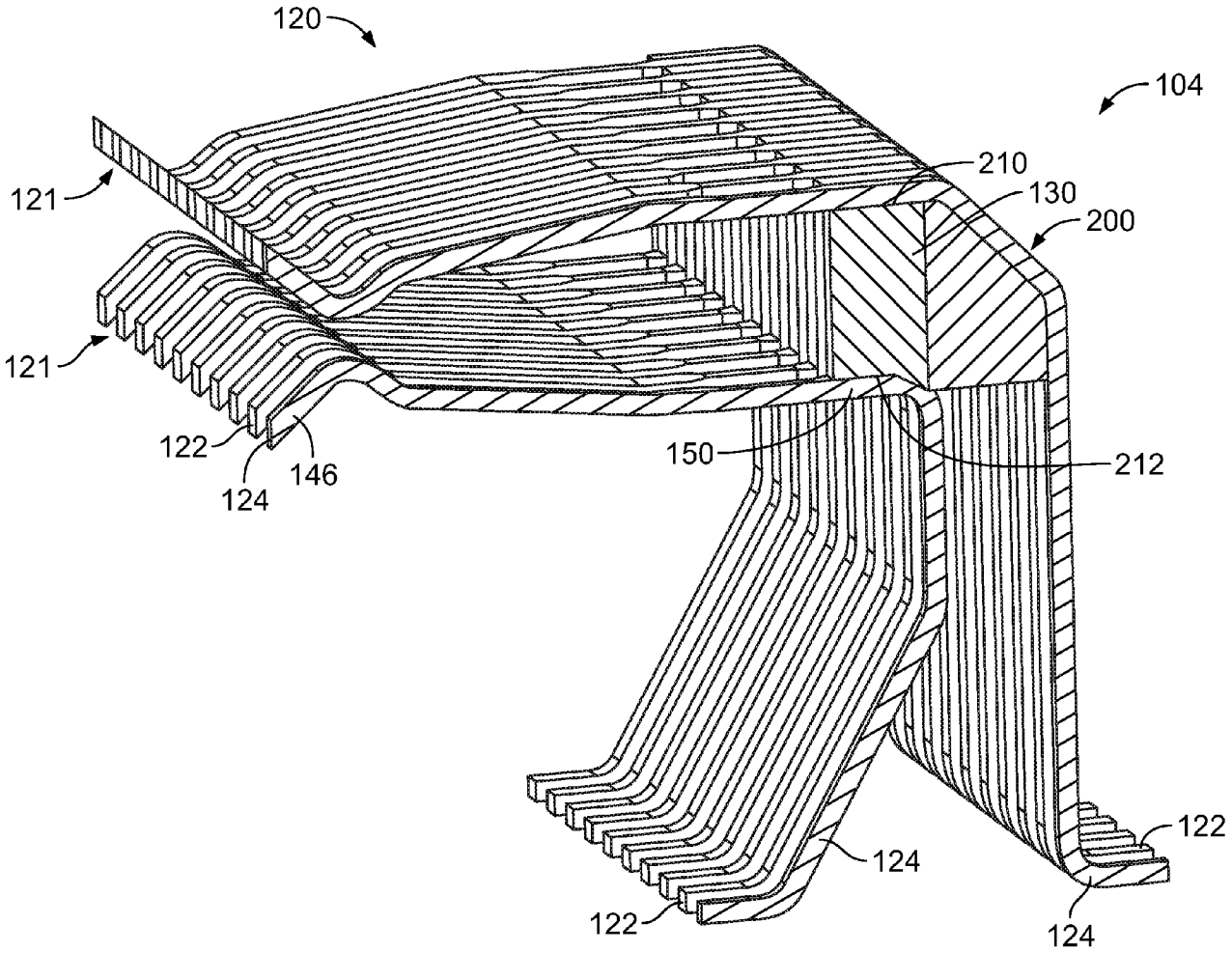
FIG. 12 is a partial sectional view of a portion of the electrical connector showing contact arrays and the contact organizer in accordance with an exemplary embodiment.

FIG. 12 is a partial sectional view of a portion of the electrical connector 104 showing the contact arrays 121 and the upper contact organizer 200 holding the signal and ground contacts 122, 124 with the lower contact organizer 202 (FIG. 11) and the mating housing 118 (FIG. 1) removed to illustrate the location of the lossy fillers 130 relative to the ground contacts 124. The lossy fillers 130 extend between a top 210 and a bottom 212 of the upper contact organizer 200 to engage the transition segments 150 of the ground contacts 124. The lossy fillers 130 are positioned closer to the mating ends 146 than the embodiment shown in FIG. 6.

The lossy fillers 130 are configured to absorb at least some electrical resonance that propagates along the current path defined by the ground contacts 124 and/or at least some electrical resonance that propagates along the signal path defined by the corresponding signal contacts 122. The lossy fillers 130 may control or limit undesirable resonances that occur within the ground contacts 124 during operation of the electrical connector 104. The lossy fillers 130 may effectively reduce the frequency of energy resonating within the contact assembly 120. Electrical performance of the electrical connector 104 is enhanced by the inclusion of the lossy material in the lossy fillers 130. For example, at various data rates, including high data rates, return loss is inhibited by the lossy material. For example, the return loss of the small pitch, high speed data of the contact assembly 120 due to the close proximity of signal and ground contacts 122, 124 is reduced by the lossy fillers 130. For example, energy from the ground contacts 124 on either side of the signal pair reflected in the space between the ground contacts 124 is absorbed, and thus connector performance and throughput is enhanced.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

What is claimed is:

1. An electrical connector comprising:

a housing having a mating housing and a contact organizer, the mating housing having a mating slot configured to receive a mating connector having contact pads, the contact organizer having contact channels separated by separating walls, the contact channels having inner ends between the separating walls and open outer ends opposite the inner ends, the contact channels comprising signal contact channels and ground contact channels, the contact organizer having lossy fillers at the inner ends of the ground contact channels, the lossy fillers being manufactured from lossy material capable of absorbing electrical resonance propagating through the housing; and a contact assembly disposed in the housing, the contact assembly having ground contacts and signal contacts interspersed between corresponding ground contacts, the ground and signal contacts being received in corresponding ground and signal contact channels of the contact organizer, the ground contacts being positioned adjacent the lossy fillers at the inner ends of the corresponding ground contact channels.

2. The electrical connector of claim 1, wherein the contact organizer has a base extending between a first side and a second side, the contact channels being provided at both the first and second sides, the lossy fillers spanning between the contact channels at the first and second sides.

3. The electrical connector of claim 1, wherein each lossy filler ties a plurality of ground contacts together.

4. The electrical connector of claim 1, wherein the lossy fillers include keys locking the lossy fillers in the contact organizer.

5. The electrical connector of claim 1, wherein the lossy fillers directly engage corresponding ground contacts.

6. The electrical connector of claim 1, wherein the lossy fillers are planar and spaced apart from each other along parallel ground planes.

7. The electrical connector of claim 1, wherein each lossy filler includes a first edge and a second edge, the first edge engaging a first ground contact, the second edge engaging a second ground contact.

8. The electrical connector of claim 7, wherein at least a portion of the second edge is nonparallel to the first edge.

9. The electrical connector of claim 1, wherein the contact organizer includes a base manufactured from low loss dielectric material, the base having pockets at the inner ends of the ground contact channels, the lossy fillers being injection molded in the pockets.

10. The electrical connector of claim 1, wherein the contact organizer includes a base manufactured from low loss dielectric material, the base having pockets at the inner ends of the ground contact channels, the lossy fillers being inserted into the pockets through a top of the contact organizer, the mating housing covering the top of the contact organizer.

11. The electrical connector of claim 1, wherein the mating housing and the contact organizer are separate and discrete pieces coupled together to hold the contact assembly.

12. The electrical connector of claim 1, wherein the contact organizer is an upper contact organizer, the electrical connector further comprising a lower contact organizer below the upper contact organizer, the lower contact organizer having contact channels receiving portions of the signal and ground contacts.

13. The electrical connector of claim 12, wherein the lower contact organizer includes lossy fillers engaging corresponding ground contacts in the lower contact organizer.

14. An electrical connector comprising:

a contact assembly having ground contacts and signal contacts interspersed between corresponding ground contacts, the ground and signal contacts each having mating ends configured for mating with contact pads of a mating connector, the ground and signal contacts each having contact tails opposite the mating ends, the ground and signal contacts each having transition segments between the mating ends and the contact tails, the ground and signal contacts being arranged in a first array and a second array of first and second ground contacts, respectively, and first and second signal contacts, respectively;

a housing having a mating housing and a contact organizer holding the contact assembly;

the mating housing having a mating slot configured to receive the mating connector, the first ground contacts and the first signal contacts being arranged on a first side of the mating slot and the second ground contacts and the second signal contacts being arranged on a second side of the mating slot;

the contact organizer having a base between opposite first and second sides, the contact organizer having contact channels on the first and second sides, the contact channels being separated by separating walls, the contact channels having inner ends at the base and open outer ends opposite the inner ends, the contact channels comprising signal contact channels and ground contact channels on both the first and second sides receiving corresponding signal contacts and ground contacts, the contact organizer having lossy fillers in the base at the inner ends of the ground contact channels, the lossy fillers being manufactured from lossy material capable of absorbing electrical resonance propagating through the housing.

15. The electrical connector of claim 14, wherein the lossy fillers span between the contact channels at the first and second sides.

16. The electrical connector of claim 14, wherein each lossy filler ties a plurality of ground contacts together.

17. The electrical connector of claim 14, wherein the lossy fillers are planar and spaced apart from each other along parallel ground planes.

18. The electrical connector of claim 14, wherein each lossy filler includes a first edge and a second edge, the first edge engaging a first ground contact, the second edge engaging a second ground contact.

19. The electrical connector of claim 14, wherein the base is manufactured from low loss dielectric material, the base having pockets at the inner ends of the ground contact channels, the lossy fillers being injection molded in the pockets.

20. The electrical connector of claim 14, wherein the contact organizer is an upper contact organizer, the electrical connector further comprising a lower contact organizer below the upper contact organizer, the lower contact organizer having contact channels receiving portions of the signal and ground contacts.

* * * * *